US005345299A

United States Patent [19]

Hashizume et al.

[11] Patent Number: 5,345,299

[45] Date of Patent: Sep. 6, 1994

[54] IMAGE-FORMING MACHINE WITH TONER IMAGE TRANSFER MEANS HAVING A CHARGE SUPPLY ZONE AND A TRANSFER ZONE

[75] Inventors: Masahiro Hashizume; Hiroshi Kimura; Hiroshi Ishida; Masanobu Maeshima; Koichi Yasuda; Shigeki Hayashi; Hiroshi Kubota; Osamu Yoshimura; Susumu Taniguchi, all of Osaka; Yasuo Hatate, Kagoshima, all of Japan

[73] Assignee: Mita Industrial Co., Ltd., Japan

[21] Appl. No.: 120,454

[22] Filed: Sep. 14, 1993

[30] Foreign Application Priority Data

Oct. 22, 1992 [JP] Japan ..... 4-284122

[51] Int. Cl.[5] ..... G03G 15/16

[52] U.S. Cl. ..... 355/274; 355/219; 361/225

[58] Field of Search ..... 355/219, 271, 274, 276, 355/277; 361/220, 221, 225, 230

[56] References Cited

U.S. PATENT DOCUMENTS 3,647,292 3/1972 Weikel, Jr. ..... 355/274
4,101,212 7/1978 Sumiyoshi et al. ..... 355/274
4,575,216 3/1986 Hebert et al. ..... 355/274
5,172,173 12/1992 Goto et al. ..... 355/274 X

FOREIGN PATENT DOCUMENTS 61-32080 2/1986 Japan ..... 355/274

*Primary Examiner*—A. T. Grimley
*Assistant Examiner*—William J. Royer
*Attorney, Agent, or Firm*—Beveridge, DeGrandi, Weilacher & Young

[57] ABSTRACT

An image-forming machine equipped with a transfer device means of the type not using a transfer corona discharger is disclosed. A charge supply member is disposed opposite to an image forming member on whose surface a toner image is to be formed and at a greater distance than the thickness of a transfer material from the image forming member. In a transfer zone, the surface of the transfer material is brought into contact with the surface of the image forming member. In a charge supply zone, the transfer material is contacted with the surface of the charge supply member. In the direction of conveyance of the transfer material, the charge supply zone is positioned downstream of the transfer zone.

9 Claims, 3 Drawing Sheets

IMAGE-FORMING MACHINE WITH TONER IMAGE TRANSFER MEANS HAVING A CHARGE SUPPLY ZONE AND A TRANSFER ZONE

FIELD OF THE INVENTION

This invention relates to an image-forming machine of the type adapted to form a latent electrostatic image on the surface of an image-forming member such as an electrostatic photosensitive member, develop the latent electrostatic image to a toner image, and then transfer the toner image onto a transfer material such as a paper.

DESCRIPTION OF THE PRIOR ART

As is well known to those skilled in the art, in the above-mentioned type of image-forming machine, the image-forming member such as an electrostatic photosensitive member disposed on the peripheral surface of a rotating drum is conveyed through an endless conveying passage, which comprises a latent electrostatic image forming zone, a developing zone, and a transfer zone in this sequence, according to the rotation of the rotating drum in a predetermined direction. In the latent electrostatic image forming zone, a latent electrostatic image is formed on the surface of the image-forming member by the action of latent electrostatic image forming means. The latent electrostatic image forming means comprises a uniform charging means for uniformly charging the surface of the image forming member with a predetermined polarity, and exposure means for exposing to light the surface of the image forming member in correspondence with an image to be formed, subsequently to the uniform charging. In the developing zone, a toner is applied, by a developing device, to the latent electrostatic image that has been formed on the surface of the image forming member, whereby the latent electrostatic image is developed to a toner image. In the transfer zone, the surface of the transfer material is brought into contact with the surface of the image forming member so that the toner image formed on the surface of the image forming member is transferred onto the surface of the transfer material by the action of transfer means.

A typical example of the transfer means is a transfer corona discharger for applying to the back of the transfer material in the transfer zone a corona discharge of an opposite polarity to the polarity of the latent electrostatic image that has been formed on the surface of the image forming member. The transfer corona discharger, however, poses problems such as the considerable generation of ozone which is undesirable in view of environmental pollution.

To solve the above problem, Japanese Laid-Open Patent Publication No. 75773/1988, etc. have proposed that transfer means be constituted not by a charging corona discharger, but by a conductive roller disposed in proximity to the image forming member in the transfer zone (more specifically, with the distance between the image forming member and the conductive roller being made smaller than the thickness of the transfer material). Such a conductive roller is rotationally driven in the direction of conveyance of the transfer material, and is given a voltage of an opposite polarity to the polarity of the latent electrostatic image that has been formed on the image forming member. The transfer material is interposed between the image forming member and the conductive roller, so that it is passed through the transfer zone with its surface pressed against the surface of the image forming member. During this passing, the toner image on the surface of the image forming member is transferred onto the surface of the transfer material.

According to experiments and investigations by us, the present inventors, the use of the above-described transfer means results in a considerable pressure of contact between the surface of the image forming member and the surface of the transfer material. This tends to cause a partial missing phenomenon in which no toner is present, for example, in some characters in the transferred image, or an image dust phenomenon in which a scattered toner deposits around the characters in the transferred image.

To overcome the above problems ascribed to the excessive pressure of contact between the surface of the image forming member and the surface of the transfer material, Japanese Laid-Open Patent Publication No. 200277/1989 discloses that the distance between an image forming member and a charge supply member such as a conductive roller is set to be greater than the thickness of a transfer material, and that the back of the transfer material is brought into contact with the charge supply member such as a conductive roller in a charge supply zone upstream, as viewed in the direction of conveyance of the transfer material, of the transfer zone where the surface of the transfer material is brought into contact with the surface of the image forming member.

The mechanism disclosed in Japanese Laid-Open Patent Publication No. 200277/1989, however, is still unsatisfactory, because it involves the following problems: An electric field to be formed by the charge supply member disposed upstream of the transfer zone may act on the surface of the image forming member upstream of the transfer zone, disturbing that toner image before transfer which is formed on the surface of the image forming member.

Summary of the Invention

A main object of this invention is to provide an image-forming machine which has an improved transfer means of the type using a charge supply member such as a conductive roller instead of a transfer corona discharger, and in which a sufficiently satisfactory transfer can be accomplished, while preventing from exerting an excessively high contact pressure on the surface of the image forming member, and avoiding the possibility of a pre-transfer toner image formed on the surface of the image forming member being disturbed upstream of the transfer zone.

In the present invention, the charge supply zone, where the transfer material is contacted with the charge supply member disposed opposite to the image forming member at a greater distance than the thickness of the transfer material, is positioned downstream, not upstream, of the transfer zone, where the surface of the transfer material is contacted with the surface of the image forming member, as viewed in the direction of conveyance of the transfer material, whereby the aforementioned technological objective is attained.

The present invention provides an image-forming machine capable of attaining the above object. The image-forming machine comprises an image forming member to be conveyed through a conveying passage which comprises a latent electrostatic image forming zone, a developing zone, and a transfer zone in this sequence, latent electrostatic image forming means for forming a latent electrostatic image on the surface of the image forming member in the latent electrostatic image forming zone, developing means for developing the latent electrostatic image on the surface of the image forming member to a toner image in the developing zone, transfer material conveying means for conveying a transfer material through the transfer zone, and toner image transfer means for transferring the toner image on the surface of the image forming member onto the surface of the transfer material in the transfer zone, the toner image transfer means including a charge supply member disposed opposite to the image forming member at a greater distance than the thickness of the transfer material, the transfer material being brought into contact with the charge supply member in a charge supply zone to receive a charge, and the surface of the transfer material being brought into contact with the surface of the image forming member in the transfer zone to transfer the toner image on the surface of the image forming member onto the surface of the transfer material; wherein the charge supply zone is positioned downstream of the transfer zone as viewed in the direction of conveyance of the transfer material.

The distance between the transfer zone and the charge supply zone in the direction of conveyance of the transfer material is preferably 1.0 to 5.0 mm.

In the image-forming machine of the present invention, the charge supply zone is positioned downstream of the transfer zone as viewed in the direction of conveyance of the transfer material. Hence, it never happens that an electric field produced by the charge supply member acts on and disturbs a pre-transfer toner image, which has been formed on the surface of the image forming member, upstream of the transfer zone. The electric field produced by the charge supply member acts on the surface of the image forming member downstream of the transfer zone. However, the toner image on the surface of the image forming member has already been transferred onto the transfer material downstream of the transfer zone. Therefore, no trouble will occur when the electric field produced by the charge supply member acts on the surface of the image forming member.

Since the charge supply zone is positioned downstream of the transfer zone as viewed in the direction of conveyance of the transfer material, the following state arises: A front end portion of the transfer material has already been contacted with the surface of the image forming member in the transfer zone, but the transfer material has not yet been contacted with the charge supply member, so that no charge has been supplied to the transfer material. In the above state existent before the front end of the transfer material contacts the charge supply member in the charge supply zone, the toner image is not transferred from the image forming member to the transfer material in the transfer zone, and so some non-transfer area is formed in the front end portion of the transfer material. As is well known to one skilled in the art, however, it is customary to intentionally form a non-image area of some length in the front end portion of the transfer material in order to reliably separate from the surface of the image forming member the transfer material intimately contacted with the surface of the image forming member in the transfer zone, or in order to reliably separate from the surface of a fixing roller the transfer material intimately contacted with the surface of the fixing roller in a fixing step subsequent to transfer. Hence, any problems ascribable to the formation of the non-transfer area do not occur if the distance between the charge supply zone and the transfer zone in the direction of conveyance of the transfer material is sufficiently reduced, thereby making the length of the non-transfer area in the front end portion of the transfer material equal to or smaller than the length of the non-image area.

Detailed Description of Preferred Embodiments

Preferred embodiments of an image-forming machine constructed in accordance with the present invention will be described in detail below with reference to the accompanying drawings.

Figure 1:
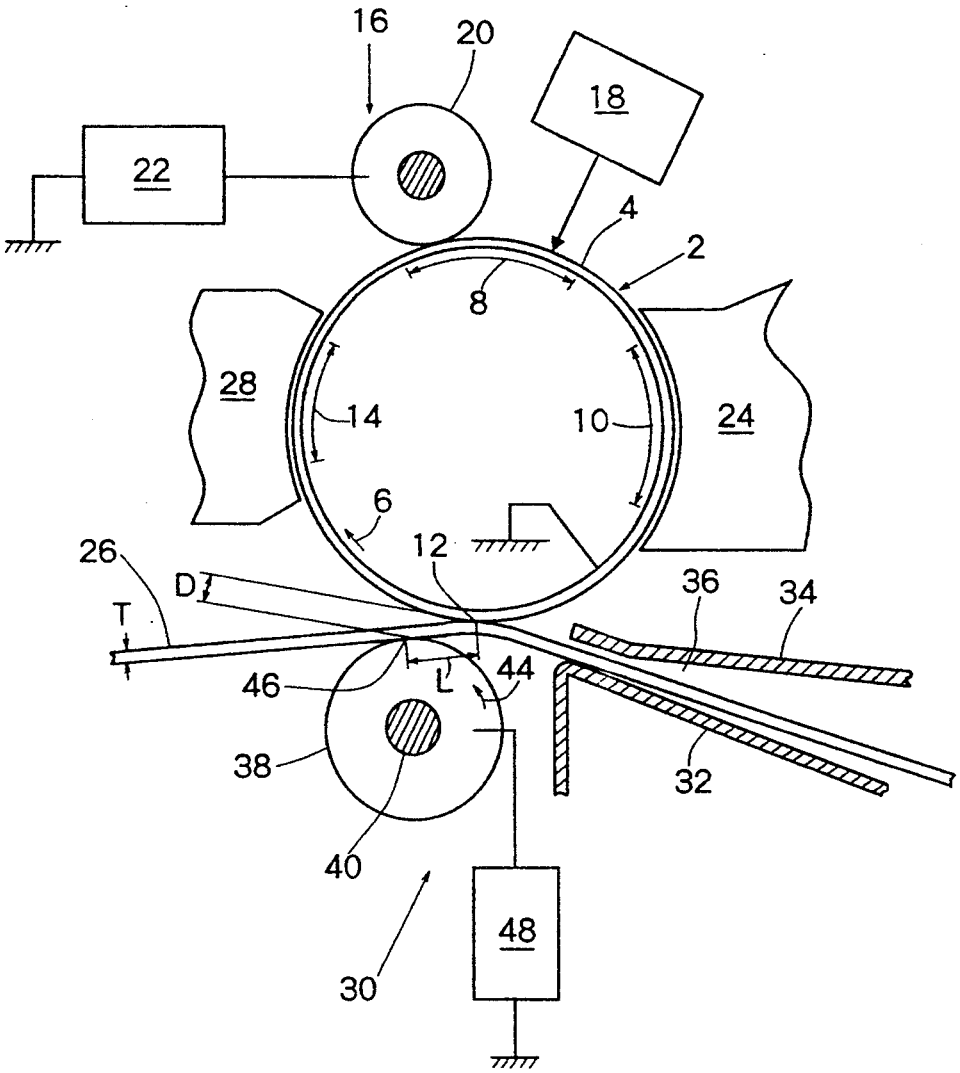
FIG. 1 is a sectional view showing in a simplified manner the main constituent elements of an image-forming machine with a transfer means improved in accordance with the present invention.

With reference to FIG. 1, which shows in a simplified manner the main constituent elements of a preferred embodiment of an image-forming machine constructed in accordance with the present invention, the image-forming machine has a rotating drum 2 which is mounted rotatably. On the peripheral surface of the rotating drum 2 is disposed an image-forming member 4 which may be an appropriate electrostatic photosensitive member. The rotating drum 2 is rotationally driven continuously in a direction shown by an arrow 6, whereby the image-forming member 4 disposed on its surface is conveyed through an endless conveying passage (a circular conveying passage defined by the peripheral surface of the rotating drum 2) which comprises a latent electrostatic image forming zone 8, a developing zone 10, a transfer zone 12 and a cleaning zone 14 in this sequence.

In the latent electrostatic image forming zone 8, a latent electrostatic image is formed on the surface of the image forming member 4 by a latent electrostatic image forming means including a uniform charging means 16 and an exposure means 18. The uniform charging means 16 uniformly charges the surface of the image forming member 4 with a specific polarity (a positive polarity in the drawing). The uniform charging means 16 may be constructed of a so-called contact charging means including a uniform charging roller 20. To the uniform charging roller 20 formed of a conductive rubber is applied a desired voltage by a voltage application means 22. Such a contact charging means itself is known to the public, and is described in detail, for example, in the Journal of the Society of Electrophotography, Vol. 30, No. 3, pp. 312–322 "Method of Contact Charging." If desired, a uniform charging means comprising an ordinary corona discharger may be used instead of the contact charging means. The exposure means 18 selectively eliminates the charge on the surface of the image forming member 4 by light irradiation, thereby to form a latent electrostatic image on the surface of the image forming member 4. Such exposure means 18 may be constituted of a laser means which projects light on the surface of the image forming member 4 in accordance with an image signal from a computer or a word processor. Alternatively, the exposure means 18 may be constituted of an optical means which projects on the surface of the image forming member 4 light reflected from the document to be copied. In the developing zone 10, a developing device 24 constituted of a magnetic brush mechanism or the like applies a toner to a latent electrostatic image formed on the surface of the image forming member 4, thereby developing the latent electrostatic image to a toner image. In the illustrated embodiment, a toner charged with a positive polarity, the same polarity as the polarity of the latent electrostatic image formed on the surface of the image forming member 4, is applied to uncharged regions of the latent electrostatic image formed on the surface of the image forming member 4, whereby the latent electrostatic image is developed (reversal development). In the transfer zone 12, the toner image on the surface of the image forming member 4 is transferred onto the surface of a transfer material 26 which is conveyed through the transfer zone 12. The transfer material 26 may be a sheet-like ordinary paper. The transfer of the toner image in the transfer zone 12 will be described later on in more detail. In the cleaning zone 14, the toner remaining on the surface of the image forming member 4 after transfer is removed from the surface of the image forming member 4 by a cleaning means 28. The cleaning means 28 may be of a well known type including a cleaning blade to be contacted with the surface of the image forming member 4.

With reference to FIG. 1, a transfer means 30 disposed in conjunction with the transfer zone 12 includes lower and upper guide plates 32 and 34 which guide, as required, the transfer material 26 conveyed by a conveying means such as a conveying roller pair (not shown) to bring the surface of the transfer material 26 into contact with the surface of the image forming member 4 in the transfer zone 12. The lower and upper guide plates 32 and 34 define a conveying passage 36 which extends upstream of the transfer zone 12 toward the transfer zone 12 in an upwardly inclined manner. Since the transfer material 26 is conveyed through the conveying passage 36 into the transfer zone 12, the surface of the transfer material 26 is contacted reliably with the surface of the image forming member 4 in the transfer zone 12. By contact with the surface of the image forming member 4 in the transfer zone 12, the moving direction of the transfer member 26 is changed at some angle counterclockwise in FIG. 1. In consequence, the transfer material 26 is forced to move downwardly inclinedly at a slight angle downstream of the transfer zone 12.

It is important that the transfer means 30 includes a charge supply member 38 with which the transfer material 26 is brought into contact downstream of the transfer zone 12. In the illustrated embodiment, a rotating shaft 40 is rotatably disposed below the rotating drum 2 downstream of the transfer zone 12, and a roller constituting the charge supply member 38 is fixed to the rotating shaft 40. The rotating shaft 40 is rotationally driven at a desired speed in a direction shown by an arrow 44. The peripheral speed of the charge supply member (roller) 38 may be substantially the same as the peripheral speed of the image forming member 4 disposed on the rotating drum 2. The roller constituting the charge supply member 38 is advantageously formed of a conductive synthetic rubber with a volume resistivity of about $10^5$ to $10^8$ Ω-cm. As clearly shown in FIG. 1, the back of the transfer material 26 which moves in a slightly downwardly inclined manner from the transfer zone 12 is brought into contact with the surface of the charge supply member 38 in a charge supply zone 46 positioned downstream of the transfer zone 12. To the charge supply member 38 is connected a voltage application means 48. The voltage application means 48 applies to the charge supply member 38 a voltage of an opposite polarity (a negative polarity in the drawing) to the polarity (a positive polarity in the drawing) of the latent electrostatic image formed on the surface of the image forming member 4. The absolute value of the voltage applied to the charge supply member 38 may be about 300 to 3,000 V. The distance D between the image forming member 4 disposed on the peripheral surface of the rotating drum 2 and the surface of the roller constituting the charge supply member 38 should importantly be set to be greater than the thickness T of the transfer material 26 passing between the two members, and it is preferably about 0.2 to 2 mm. The distance L between the transfer zone 12 and the charge supply zone 46 in the direction of conveyance of the transfer material 26 is preferably about 1.0 to 5.0 mm.

An electric field is formed between the charge supply member 38, which receives a voltage applied from the voltage application means 48, and the image forming member 4 which is grounded. Upon contact of the back of the transfer material 26 with the surface of the charge supply member 38 in the charge supply zone 46, the transfer material 26 is supplied with a charge (a negative charge in the illustrated embodiment). Thus, a toner image is effectively transferred from the surface of the image forming member 4 to the surface of the transfer material 26 in the transfer zone 12. The electric field formed between the charge supply member 38 and the image forming member 4 is present mainly downstream of the transfer zone 12, and such electric field present upstream of the transfer zone is slight if any. The charge supplied from the charge supply member 38 to the transfer material 26 flows from the image forming member 4 to the ground in the transfer zone 12. Therefore, substantially no charge is present in the transfer material 26 upstream of the transfer zone 12. This mechanism fully reliably avoids the situation that a toner image formed on the surface of the image forming member 4 is disturbed upstream of the transfer zone 12 before the surface of the transfer material 26 is contacted with the surface of the image forming member 4. The distance D between the surface of the image forming member 4 and the surface of the charge supply member 38 is set to be greater than the thickness T of the transfer material 26. Thus, the surface of the transfer material 26 is not pressed, with an excessive force, against the surface of the image forming member 4. Hence, the so-called partial missing phenomenon or the generation of an image dust can be reliably prevented in the toner image transferred to the surface of the transfer material 26.

During the period from the passage of the front end of the transfer material 26 through the transfer zone 12 until its arrival at the charge supply zone 46 to contact with the charge supply member 38, the surface of the transfer material 26 is kept in contact with the surface of the image forming member 4, while the back of the transfer material 26 is not contacted with the surface of the charge supply member 38, so that no charge has been supplied from the charge supply member 38 to the transfer material 26. In this state, a toner image is not effectively transferred from the surface of the image forming member 4 to the surface of the transfer material 26. Hence, a non-transfer area where the toner image is not transferred is formed in that length in the front end portion of the transfer material 26 which corresponds to the aforementioned distance L (the distance between the transfer zone 12 and the charge supply zone 46 in the direction of conveyance of the transfer material 26). As has been stated earlier, however, in the image-forming machine, as usual, a non-image area of some length is intentionally formed in the front end portion of the transfer material so that the transfer material may be separated from the surface of the fixing roller (not shown) with which the surface of the transfer material 26 is to be intimately contacted in a fixing step after the transfer step. Therefore, by making the above-mentioned distance L sufficiently small to make the length of the above non-transfer area equal to or smaller than the length of the non-image area, there can be prevented the occurrence of problems associated with the formation of the non-transfer area.

The charge supply member 38 is not limited to the shape illustrated herein. If desired, the charge supply member 38 may be constituted of a conductive endless belt which is driven in a direction shown by arrow 44, or of a stationary conductive member with a sufficiently smooth surface with which the transfer material 26 is to be contacted. In the illustrated embodiment, the back of the transfer material 26 is contacted with the surface of the charge supply member 38, but instead the surface of the transfer material 26 may be contacted with the surface of the charge supply member 38. (In this case, the surface of the charge supply member 38 contacts the toner image transferred onto the surface of the transfer material 26. Therefore, it is necessary to apply a polytetrafluoroethylene coating to the surface of the charge supply member 38 so that the toner may not adhere to this surface.)

Figure 2:
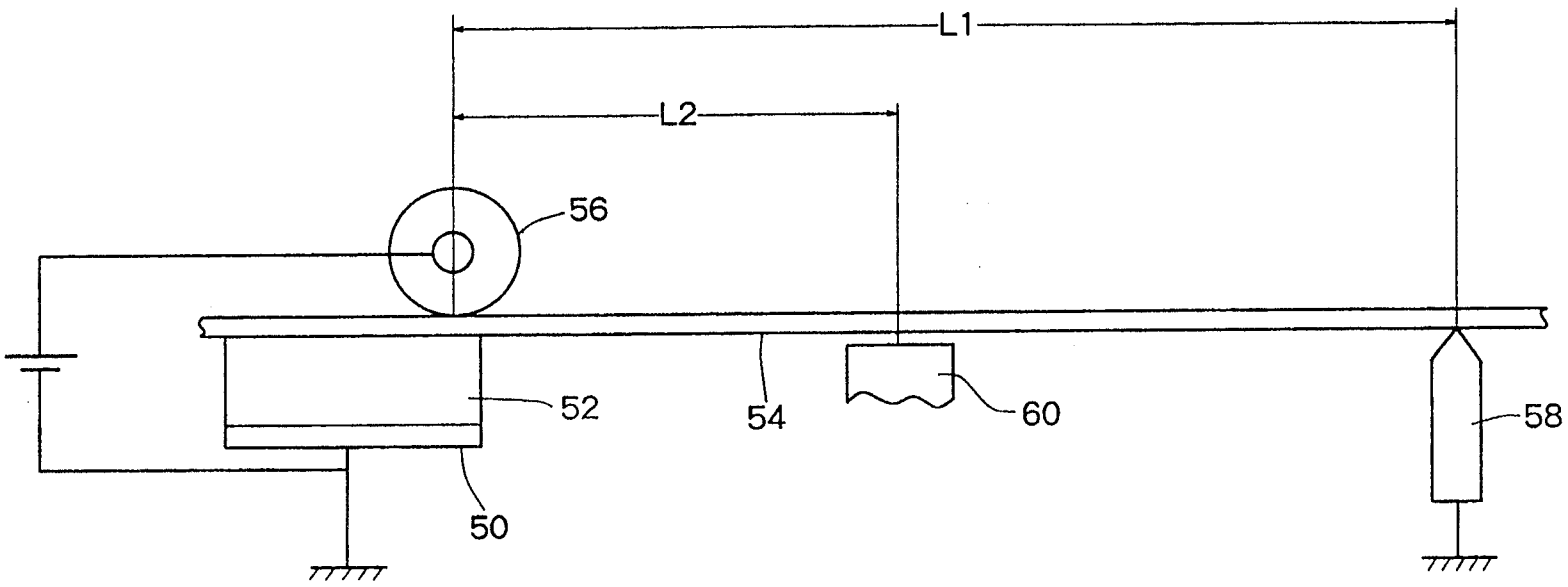
FIG. 2 is a sectional view showing in a simplified manner a device for charge supply experiments.
Figure 3:
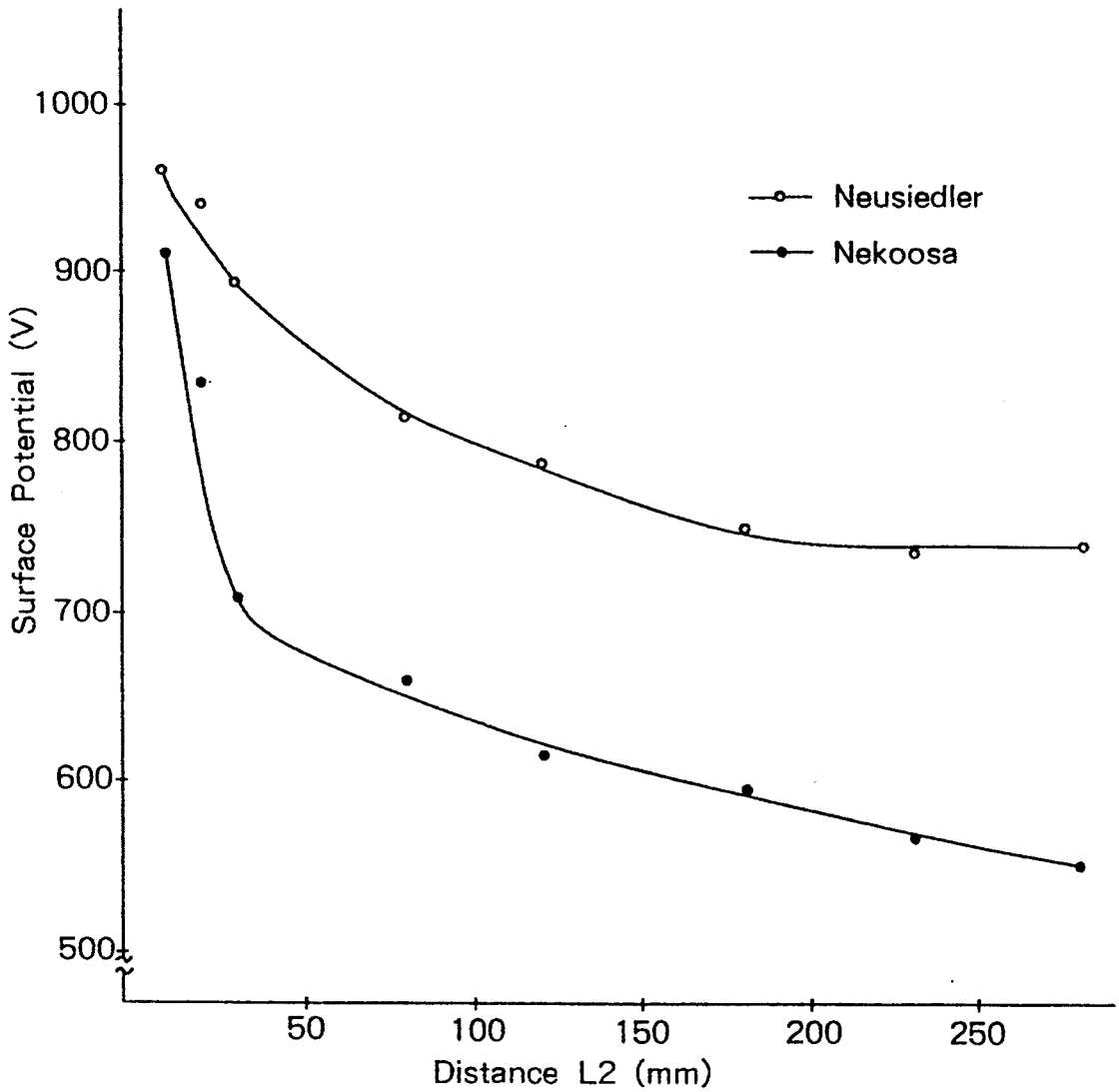
FIG. 3 is a graph showing the results of measurement in charge supply experiment.

Next, experiments on charge supply from a charge supply member to a transfer material will be mentioned. With reference to FIG. 2 which schematically shows a device for experiments, a part of a transfer material 54 was laid on a support board having a polyacetal plate 52 (15 mm thick) as an insulator laminated on a stainless steel substrate 50. From above the transfer material 54, a conductive rubber roller 56 was contacted with that part of the transfer material 54, and a negative voltage was applied between the stainless steel substrate 50 and the roller 56. The undersurface of the transfer material 54 was grounded via a stainless steel connecting member 58 at a site apart from the roller 56 by the distance L1 (350 mm). The potential of the undersurface of the transfer material 54 was measured with a surface potential measuring device 60 at a site apart from the roller 56 by the distance L2 (10–280 mm). The outside diameter of the roller 56 was 14 mm, and its volume resistivity was $5.7\times10^7$ Ω-cm. The pressure of the roller 56 on the upper surface of the transfer material 54 was 4.6 g/cm, and the voltage applied was −1,000 V. The distance between the probe of the surface potential measuring device 60 and the undersurface of the transfer material 54 was 2 mm. The experiment was conducted at a temperature of 23° C. and a humidity of 65%. The transfer materials used were a 0.10 mm thick Neusiedler (trade name) paper widely used in European countries, and a 0.10 mm thick Nekoasa (trade name) paper widely used in the United States. The measurement results were as shown in FIG. 3. The surface potential at a site more apart from the roller 56 than the site of grounding via the connecting member 58 ($L2 \geqq L1$) was substantially zero.

Preferred embodiments of an image-forming machine constructed in accordance with the present invention have been described in detail with reference to the appended drawings. It should be understood, however, that the present invention is not limited to such embodiments, but various changes and modifications may be made without departing from the scope of the present invention.

What we claim is:

1. An image-forming machine comprising an image forming member to be conveyed through a conveying passage which comprises a latent electrostatic image forming zone, a developing zone, and a transfer zone in this sequence, latent electrostatic image forming means for forming a latent electrostatic image on the surface of the image forming member in the latent electrostatic image forming zone, developing means for developing the latent electrostatic image on the surface of the image forming member to a toner image in the developing zone, transfer material conveying means for conveying a transfer material through the transfer zone, and toner image transfer means for transferring the toner image on the surface of the image forming member onto the surface of the transfer material in the transfer zone, the toner image transfer means including a charge supply member disposed opposite to the image forming member at a greater distance than the thickness of the transfer material, the transfer material being brought into contact with the charge supply member in a charge supply zone to receive a charge, and the surface of the transfer material being brought into contact with the surface of the image forming member in the transfer zone to transfer the toner image on the surface of the image forming member onto the surface of the transfer material; wherein the charge supply zone is positioned downstream of the transfer zone as viewed in the direction of conveyance of the transfer material.

2. The image-forming machine of claim 1 wherein the distance between the transfer zone and the charge supply zone in the direction of conveyance of the transfer material is 1.0 to 5.0 mm.

3. The image-forming machine of claim 1 wherein the distance between the charge supply member and the image forming member is 0.2 to 2.0 mm.

4. The image-forming machine of claim 1 wherein the back of the transfer material is brought into contact with the surface of the charge supply member.

5. The image-forming machine of claim 1 wherein the charge supply member is formed of a conductive material, and the toner image transfer means includes voltage application means for applying a voltage to the charge supply member.

6. The image-forming machine of claim 5 wherein a toner charged with the same polarity as the polarity of the charge of the latent electrostatic image formed on the surface of the image forming member is applied to the surface of the image forming member to develop the latent electrostatic image to a toner image, and the voltage application means applies to the charge supply member a voltage of an opposite polarity to the polarity of the charge of the latent electrostatic image formed on the surface of the image forming member.

7. The image-forming machine of claim 6 wherein the absolute value of the voltage applied to the charge supply member is 300 to 3,000 V.

8. The image-forming machine of claim 5 wherein the charge supply member is formed of a conductive rubber.

9. The image-forming machine of claim 1 wherein the charge supply member is a roller mounted on a rotating shaft and is rotationally driven in the direction of conveyance of the transfer material.

* * * * *